US008593354B2

(12) United States Patent
Tai et al.

(10) Patent No.: US 8,593,354 B2
(45) Date of Patent: Nov. 26, 2013

(54) MULTI-BAND ANTENNA

(75) Inventors: Lung-Sheng Tai, New Taipei (TW); Chun-Ming Chiu, New Taipei (TW); Po-Kang Ku, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 393 days.

(21) Appl. No.: 13/007,784

(22) Filed: Jan. 17, 2011

(65) Prior Publication Data

US 2011/0175794 A1 Jul. 21, 2011

(30) Foreign Application Priority Data

Jan. 15, 2010 (TW) ..... 99200813

(51) Int. Cl.
*H01Q 1/24* (2006.01)
*H01Q 1/38* (2006.01)

(52) U.S. Cl.
USPC ..... 343/702; 343/700 MS; 343/846; 343/908

(58) Field of Classification Search
None
See application file for complete search history.

(56) References Cited

U.S. PATENT DOCUMENTS 7,466,272 B1 * 12/2008 Su et al. ..... 343/700 MS
7,642,967 B2 * 1/2010 Wang et al. ..... 343/702
7,839,342 B2 * 11/2010 Su et al. ..... 343/702
2006/0262016 A1 * 11/2006 Hung et al. ..... 343/702
2007/0171130 A1 * 7/2007 Chung et al. ..... 343/700 MS
2008/0030407 A1 * 2/2008 Hung et al. ..... 343/700 MS
2008/0266185 A1 * 10/2008 Hung et al. ..... 343/700 MS
2008/0278382 A1 * 11/2008 Hung et al. ..... 343/700 MS
2008/0309563 A1 * 12/2008 Wang et al. ..... 343/702
2009/0027277 A1 * 1/2009 Su et al. ..... 343/700 MS
2009/0109098 A1 * 4/2009 Hung et al. ..... 343/700 MS
2009/0135070 A1 * 5/2009 Hung et al. ..... 343/700 MS
2011/0037680 A1 * 2/2011 Chiu et al. ..... 343/893

* cited by examiner

*Primary Examiner* — Trinh Dinh
(74) *Attorney, Agent, or Firm* — Wei Te Chung; Ming Chieh Chang

(57) ABSTRACT

A multi-band antenna (1), comprising a grounding element (10) extending horizontally along a longitudinal direction, comprising a side edge (101) with a connecting point (102) and a grounding point (103) distanced from the connecting point by a length; a radiating element (11) disposed at an upper level parallel to the grounding element and defining a first end and a second end, and operating in a first frequency band; a connecting element (12) located between the radiating element and the grounding element, comprising a first portion (121) connecting to the first end of the radiating element and a second portion (122) linking to said connecting point of the grounding element; a parasitic element (13) extending from the second portion of the connecting element towards the second end of the radiating element along the longitudinal direction, and operating in a second frequency band; a feeding point (141) disposed on the second portion of the connecting element and under the parasitic element; and a feeding line (15) comprising an inner conductor connected to the feeding point and an outer conductor connected to the grounding point; wherein said connecting element, the grounding element, the feeding point and the grounding point together forming a slot (16) operating in a third frequency band.

20 Claims, 3 Drawing Sheets

MULTI-BAND ANTENNA

RELATED APPLICATIONS

This application claims priority under 35 U.S.C 119 from TAIWAN 99200813 filed on Jan. 15, 2010, the contents of which are incorporated herein by references.

BACKGROUND OF THE INVENTION

1. Field of the Invention

The present invention relates generally to a multi-band antenna, and more particularly to a multi-band antenna used in an electric device.

2. Description of the Prior Art

In recent years, developments of portable wireless communication devices are speeded up. Considering the competitiveness, an antenna built in the device must have small size to save space and increase convenience.

Many electronic devices work in WWAN (Wireless Wide Area Network), and 3G (3rd-generation) is the most popular system of WWAN. But now LTE (Long Term Evolution) is the latest standard in the mobile network technology beyond 3G. The main advantages with LTE are high throughput, low latency, plug and play, and an improved end-user experience. Several worldwide carriers announced plans to convert their networks to LTE since 2009, and LTE has been in trial operation in several countries now. However, antennas for LTE would be put in electronic devices gradually in the future. Operating frequency bands of the LTE are 700, 2100 and 2600 MHz.

However, it is a problem to design a uncomplicated antenna structure to cover frequencies above all.

Hence, in this art, an improved antenna to overcome the above-mentioned disadvantages of the prior art should be provided.

BRIEF SUMMARY OF THE INVENTION

A primary object, therefore, of the present invention is to provide a multi-band antenna with a simplify structure.

In order to implement the above object, the multi-band antenna comprises a grounding element extending horizontally along a longitudinal direction, comprising a side edge with a connecting point and a grounding point distanced from the connecting point by a length; a radiating element disposed at an upper level parallel to the grounding element and defining a first end and a second end, and operating in a first frequency band; a connecting element located between the radiating element and the grounding element, comprising a first portion connecting to the first end of the radiating element and a second portion linking to said connecting point of the grounding element; a parasitic element extending from the second portion of the connecting element towards the second end of the radiating element along the longitudinal direction, and operating in a second frequency band; a feeding point disposed on the second portion of the connecting element and under the parasitic element; and a feeding line comprising an inner conductor connected to the feeding point and an outer conductor connected to the grounding point; wherein said connecting element, the grounding element, the feeding point and the grounding point together forming a slot operating in a third frequency band.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
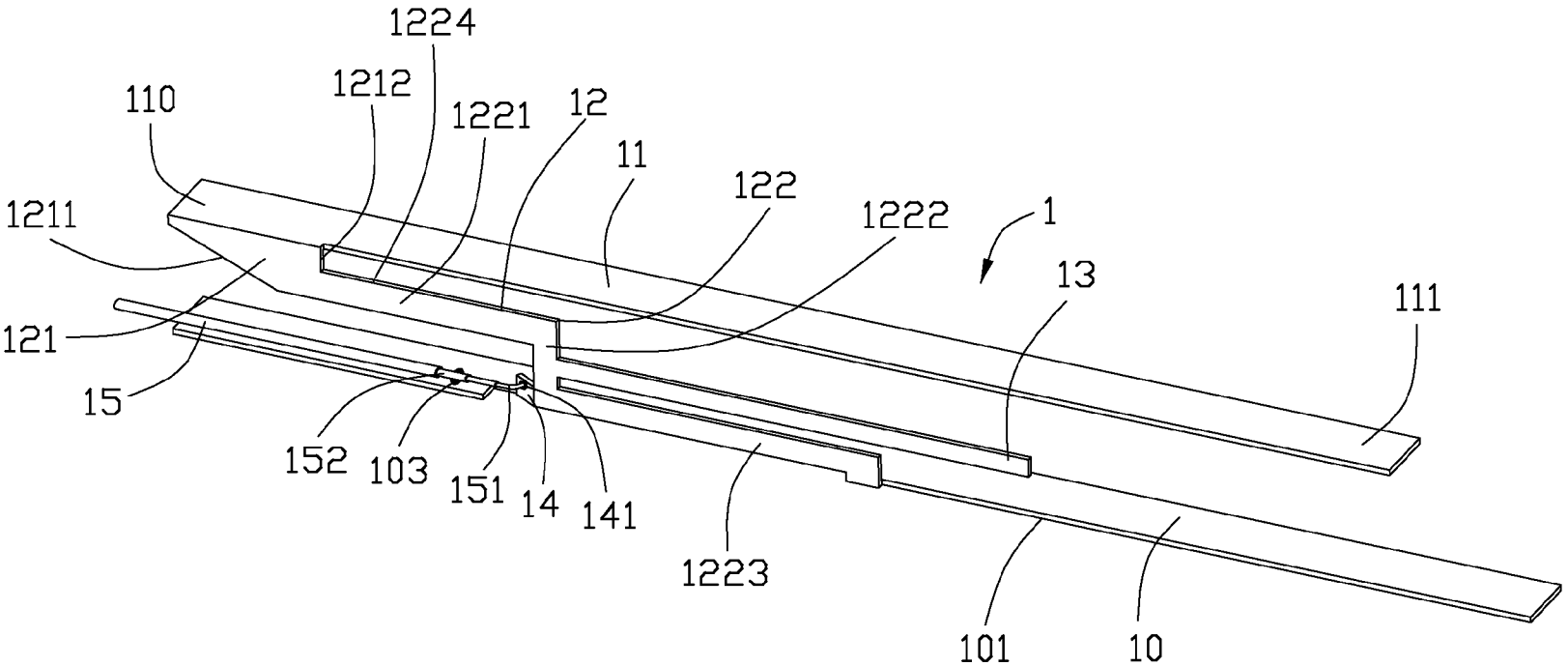
FIG. 1 is a perspective view of a multi-band antenna in accordance with a preferred embodiment of the present invention.
Figure 2:
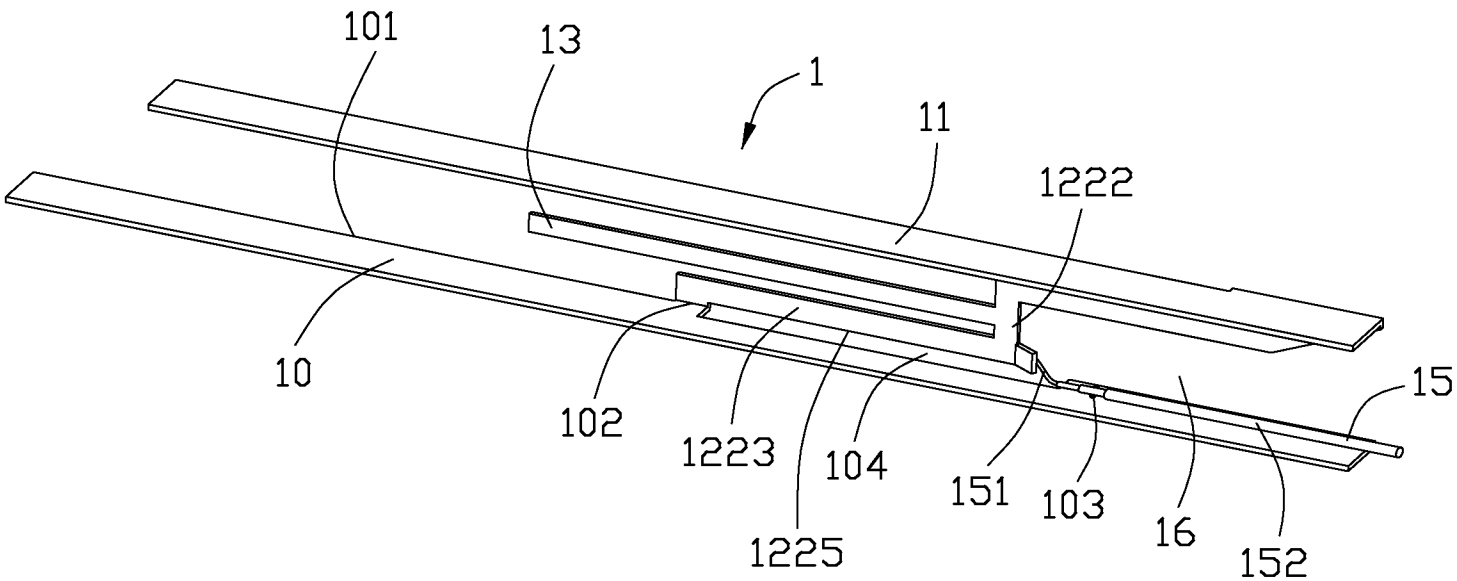
FIG. 2 is similar to FIG. 1, but viewed from another aspect.
Figure 3:
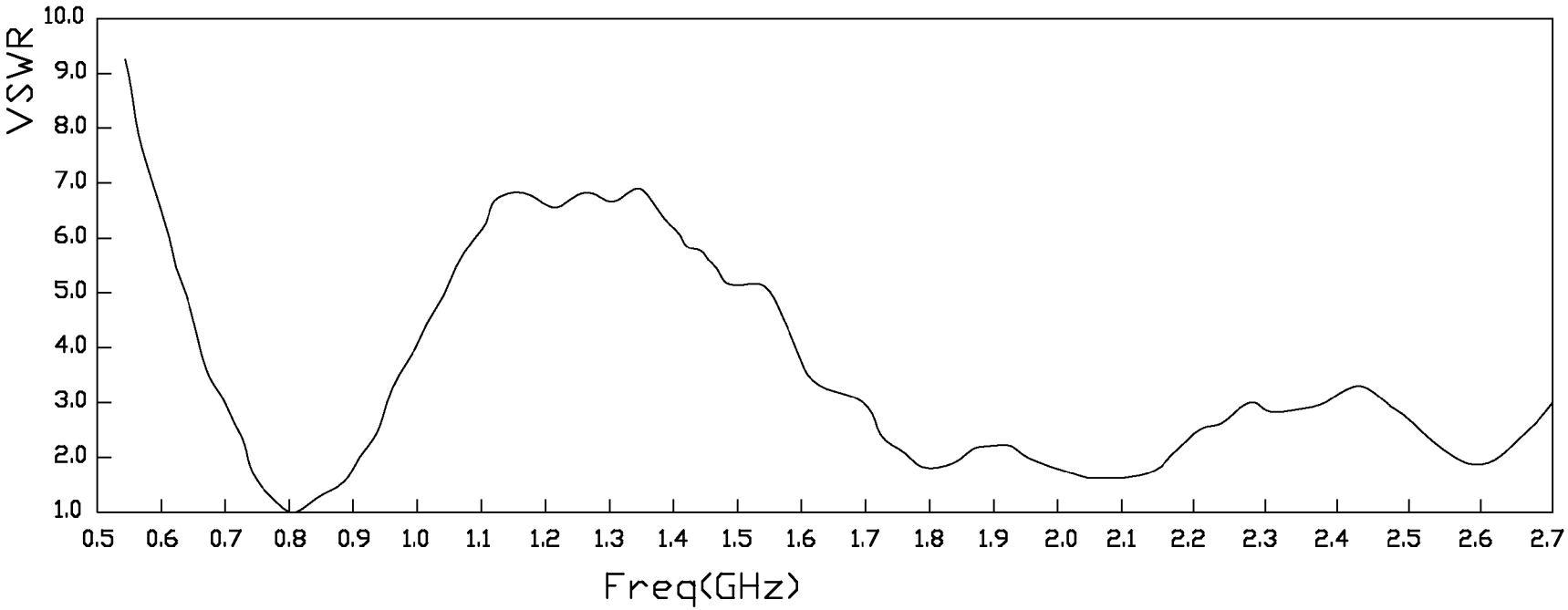
FIG. 3 is a test chart recording for the multi-band antenna of FIG. 1, showing Voltage Standing Wave Ratio (VSWR).

Reference to FIGS. 1 to 3, a multi-band antenna 1 in accordance with a preferred embodiment of the present invention comprises a grounding element 10 extending horizontally along a longitudinal direction, a radiating element 11 lying at an upper level parallel to the grounding element 10, a connecting element 12 disposed between the grounding element 10 and the radiating element 11, a parasitic element 13, a feeding element 14 and a feeding line 15.

The grounding element 10 defines a first strap structure and includes a grounding point 103 and a side edge 101 with a connecting point 102. An outlet 104 is disposed on the side edge 101 and located between the connecting point 102 and the grounding point 103. The radiating element 11 defines a second strap structure with a first end 110 and a second end 111.

The connecting element 12 defines a four-step structure and is disposed on a plane vertical to the radiating element 11 and the grounding element 10. The connecting element 12 defines a first portion 121 vertically connecting to the first end 110 of the radiating element 11, a Z-shaped second portion 122 connecting the first portion 121 to the grounding element 10. The first portion 121 defines a slantwise first side 1211 and a vertical second side 1212 oppositely and has a inverted-trapezoid configuration for expanding the width of the working frequency of the radiating element 11. The second portion 122 defines a first arm 1221 extending from the second side 1212 towards the second end 111 of the radiating element 11 along the longitudinal direction vertical to the second side 1212, a second arm 1222 extending from the first arm 1221 downwardly along a direction vertical to the second arm 1222, and a third arm 1223 extending along a same direction with the first arm 1221 and linking to the connecting point 102 of the grounding element 10. The radiating element 11 is located on an upper side 1224 of the first arm 1221. The third arm 1223 is locating upon the outlet 104. The outlet 104 of the grounding element 10 is disposed between the grounding element 10 and the lower edge 1225 of the third arm 1223.

The feeding element 14 extends from one side of the second arm 1222 with a feeding point 141. The parasitic element 13 defines a third strap structure and extends from the other side of the second arm 1222 towards the second end 111 of the radiating element 11 along the longitudinal direction. The parasitic element 13 is disposed upon the third arm 1223 and the feeding element 14. The connecting element 12 is coplanar with the parasitic element 13.

The feeding line 15 comprises an inner conductor 151 connected to the feeding point 141 to provide current for the multi-band antenna 1 and an outer conductor 152 connected to the grounding point 103 of the grounding element 10. The first arm 1221, the second arm 1222 and the grounding element 10 together form a slot 16.

The radiating element 11 operates in a first frequency band on 698-960 MHZ. The band of 698-787 MHZ is for LTE and the band of 824-960 MHZ is for WWAN. The parasitic element 13 operates in a second frequency band on 2500-2690 MHZ for LTE. The slot 16 operates in a third frequency band on 1710-2170 MHZ. The band of 1710-2155 MHZ is for LTE and the band of 1710-2170 MHZ is for WWAN.

The multi-band antenna 1 may be made by stamping or cutting a metal plate, or be printed or etched on a microwave substrate. And the grounding element 10 could be made from a metal plate while other elements of the multi-band antenna 1 are printed or etched.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna, comprising:

a grounding element extending horizontally along a longitudinal direction, comprising a side edge with a connecting point and a grounding point distanced from the connecting point by a length;

a radiating element disposed at an upper level parallel to the grounding element and defining a first end and a second end, and operating in a first frequency band;

a connecting element located between the radiating element and the grounding element, comprising a first portion connecting to the first end of the radiating element and a second portion linking to said connecting point of the grounding element;

a parasitic element extending from the second portion of the connecting element towards the second end of the radiating element along the longitudinal direction, and operating in a second frequency band;

a feeding point disposed on the second portion of the connecting element and under the parasitic element; and a feeding line comprising an inner conductor connected to the feeding point and an outer conductor connected to the grounding point; wherein said connecting element, the grounding element, the feeding point and the grounding point together forming a slot operating in a third frequency band.

2. The multi-band antenna as claimed in claim 1, wherein said first frequency band is on 698 MHZ-960 MHZ, said second frequency band is on 2500 MHZ-2690 MHZ, said third frequency band is on 1710 MHZ-2170 MHZ.

3. The multi-band antenna as claimed in claim 2, wherein said first arm defines a inverted-trapezoid configuration and includes a slantwise first side and an opposite second side extending along a direction vertical to the longitudinal direction.

4. The multi-band antenna as claimed in claim 3, wherein the second portion of the connection element is Z-shaped and defines a first arm extending from the vertical side towards the second end of the radiating element along the longitudinal direction, a third arm extending along the same direction with the first arm and linking to the connecting point of the grounding element, and a second arm vertically connecting the first arm and the third arm.

5. The multi-band antenna as claimed in claim 4, wherein the parasitic element extends from a side of the second arm along the same direction with the first arm.

6. The multi-band antenna as claimed in claim 5, wherein a feeding element extends from the other side of the second arm, and said feeding point is disposed on the feeding element.

7. The multi-band antenna as claimed in claim 6, wherein the side edge of the grounding element defines an rectangular outlet locating between the connecting point and the grounding point.

8. A multi-band antenna, comprising:

a grounding element defining a first strap structure horizontally extending along a longitudinal direction and including a grounding point;

a radiating element defining a second strap structure and disposed apart from the grounding element and parallel to the grounding element;

a connecting element defining four sections to connect the radiating element and the grounding element, defining a first portion and a second portion connecting the first portion to the grounding element, the second portion defining a first arm, a third arm connecting to the grounding element, and a second arm disposed between the first arm and the third arm;

a parasitic element defining a third strap structure and extending from the second portion of the connecting element;

a feeding point disposed under the parasitic element; and a feeding line comprising an inner conductor connected to the feeding point and an outer conductor connected to the grounding point; wherein said first arm, second arm, the feeding point and the grounding element together forming a slot.

9. The multi-band antenna as claimed in claim 8, wherein the first portion of the connecting element extends from an end of the radiating element along a direction vertical to the radiating element, and defines a slantwise first side and a opposite vertical second side.

10. The multi-band antenna as claimed in claim 9, wherein the first arm of the second portion extends from the vertical second side of the first portion towards the free end of the radiating element along a longitudinal direction.

11. The multi-band antenna as claimed in claim 10, wherein the second arm of the second portion extends from the first arm along a direction vertical to the first arm, the third arm of the second portion extends from the second arm along a same direction with the first arm.

12. The multi-band antenna as claimed in claim 10, wherein the parasitic element extends along a same direction with the first arm.

13. The multi-band antenna as claimed in claim 8, wherein an outlet is disposed on the grounding element and locating between the grounding element and a lower edge of the third arm of the connecting element.

14. A multi-band antenna comprising:

an elongated grounding element extending along a lengthwise direction;

a connecting element defining Z-shaped structure lying in a vertical plane and including a lower horizontal section with a lower side linked to the grounding element, an upper horizontal section linked to the lower horizontal section via an upwardly standing section which has two opposite sides, and said upper horizontal section being located on one of said two opposite sides;

an elongated radiating element extending along said lengthwise direction and spaced from the grounding element and connected to an upper side of the upper horizontal section via an upwardly extending portion;

a parasitic element horizontally extending from the upwardly standing section and located on the other of said two opposite sides of said upwardly standing section opposite to said upper horizontal section; and a feeder cable including an outer conductor mechanically and electrically connected to the grounding element, and an inner conductor mechanically and electrically connected to the connecting element.

15. The multi-band antenna as claimed in claim 14, wherein said parasitic element extending beyond the lower horizontal section in said direction.

16. The multi-band antenna as claimed in claim 15, wherein said parasitic element does not extend beyond the radiating element in said direction.

17. The multi-band antenna as claimed in claim 14, wherein said grounding element defines a horizontal plane which is parallel to another horizontal plane defined by the radiating element.

18. The multi-band antenna as claimed in claim 17, wherein said grounding element defines an outlet essentially located under the lower horizontal section.

19. The multi-band antenna as claimed in claim 18, wherein the connecting element is equipped with a feeding element extending from the upwardly standing section in another direction opposite to said direction.

20. The multi-band antenna as claimed in claim 15, wherein said upwardly extending portion defines essentially an inverted trapezoid configuration with a slant edge facing toward the grounding element.

* * * * *